US009616468B2

(12) United States Patent
Parslow, II

(10) Patent No.: US 9,616,468 B2
(45) Date of Patent: Apr. 11, 2017

(54) AGRICULTURAL CONTAINER WASHER AND METHOD

(75) Inventor: Harold Parslow, II, Washington, MI (US)

(73) Assignee: GREEN-AGE PRODUCTS AND SERVICES, LLC, Washington, MI (US)

( * ) Notice: Subject to any disclaimer, the term of this patent is extended or adjusted under 35 U.S.C. 154(b) by 1229 days.

(21) Appl. No.: 13/553,955

(22) Filed: Jul. 20, 2012

(65) Prior Publication Data

US 2013/0019906 A1 Jan. 24, 2013

Related U.S. Application Data

(60) Provisional application No. 61/509,724, filed on Jul. 20, 2011.

(51) Int. Cl.

| | |
|---|---|
| ***B08B 3/02*** | (2006.01) |
| ***B08B 9/08*** | (2006.01) |
| ***B08B 9/093*** | (2006.01) |
| ***B08B 9/28*** | (2006.01) |
| ***B08B 9/30*** | (2006.01) |
| ***B08B 9/34*** | (2006.01) |

(52) U.S. Cl.

CPC ..... *B08B 3/022* (2013.01); *B08B 3/024* (2013.01); *B08B 9/0861* (2013.01); *B08B 9/093* (2013.01); *B08B 9/28* (2013.01); *B08B 9/30* (2013.01); *B08B 9/34* (2013.01)

(58) Field of Classification Search

CPC ..... B08B 3/022; B08B 3/024; B08B 9/0861; B08B 9/093; B08B 9/28; B08B 9/30; B08B 9/34

USPC ..... 134/70, 71, 72, 124, 125, 129, 130, 131

See application file for complete search history.

(56) References Cited

U.S. PATENT DOCUMENTS 6,301,930 B1 * 10/2001 Warner ..... B08B 3/02 134/129

2007/0012340 A1 * 1/2007 Jones ..... A61L 2/10 134/45

* cited by examiner

*Primary Examiner* — Michael Barr
*Assistant Examiner* — Levon J Shahinian
(74) *Attorney, Agent, or Firm* — Young Basile Hanlon & MacFarlane, P.C.

(57) ABSTRACT

An agricultural seed box washing device and method includes a modular enclosure having a washing area having a stationary first spray array and a second spray array movable transverse to the path of travel of the seed box for washing all six geometric sides of the seed box. The device includes a two-directional conveyor that allows the seed box to cycle back and further through the first spray array for multiple passes through the spray arrays.

17 Claims, 12 Drawing Sheets

AGRICULTURAL CONTAINER WASHER AND METHOD

CROSS-REFERENCE TO RELATED APPLICATIONS

This application claims priority benefit to U.S. provisional patent application Ser. No. 61/509,724 filed Jul. 20, 2011, the entire contents of which is incorporated by reference.

TECHNICAL FIELD

The present invention generally pertains to the field of agricultural equipment. The inventive equipment and process is particularly useful in washing agricultural seed boxes and other containers.

BACKGROUND

In agriculture, and particularly in the agricultural seed industry, planting seed is generated in high volumes by large seed manufacturers. The seed is loaded into seed boxes which typically include a base and a removable upper ring portion which sits on and engages the base thereby practically doubling the height and volumetric capacity of the box. Typical seed boxes store approximately 50 acres of seed and weigh about 150 pounds. It is common for very large seed manufacturers to process hundreds and hundreds of seed boxes per day and have 4000-8000 seed boxes in circulation or storage.

Prior to filling, or on return from field customers and farmer end users, the seed boxes are often dirty, littered with debris and not suitable for filling with new seed. In the past, manual operations, for example several human operators with high-pressure power washers, were employed to spray and wash the interiors of the seed boxes to flush out undesired debris. Past devices and methods were slow, labor intensive and not suitable for high volume processes.

There is a need for a highly automatic, high volume and efficient device and process to wash agricultural seed boxes and other similar containers to support high volume industrial processes.

BRIEF SUMMARY

The present invention includes a modular, self-contained container washing apparatus and method. The invention is particularly useful in washing large agricultural seed boxes although other uses are contemplated.

The device includes a first module, a second module defining a wash area and a third module. A seed box is loaded into the first module and conveyed to the second module where the washing cycle takes place. A first spray array is radially positioned around a powered conveyor which moves the seed box longitudinally back and forth through the first spray array. Following the wash cycle of the first spray array, the box is held in a stationary position. A second spray array is positioned and moves transverse to the conveyor and the box to spray surfaces of the box which are oriented transverse to the conveyor for complete 360 degree spraying of the entire seed box.

The box is then conveyed to an exit side while the next box is loaded into the device for washing.

Other aspects of the environmentally friendly device and process include spray water recycling through drain management, filtration and recirculation of the spray. Controlled management of the spray cycle through sequential control of the spray arrays allows for a much smaller pump to provide the same or even increased high pressure spray to remove debris thereby saving energy to operate the device.

The present device is highly automatic, modular in design and provides rapid and efficient washing of seed boxes and other containers.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
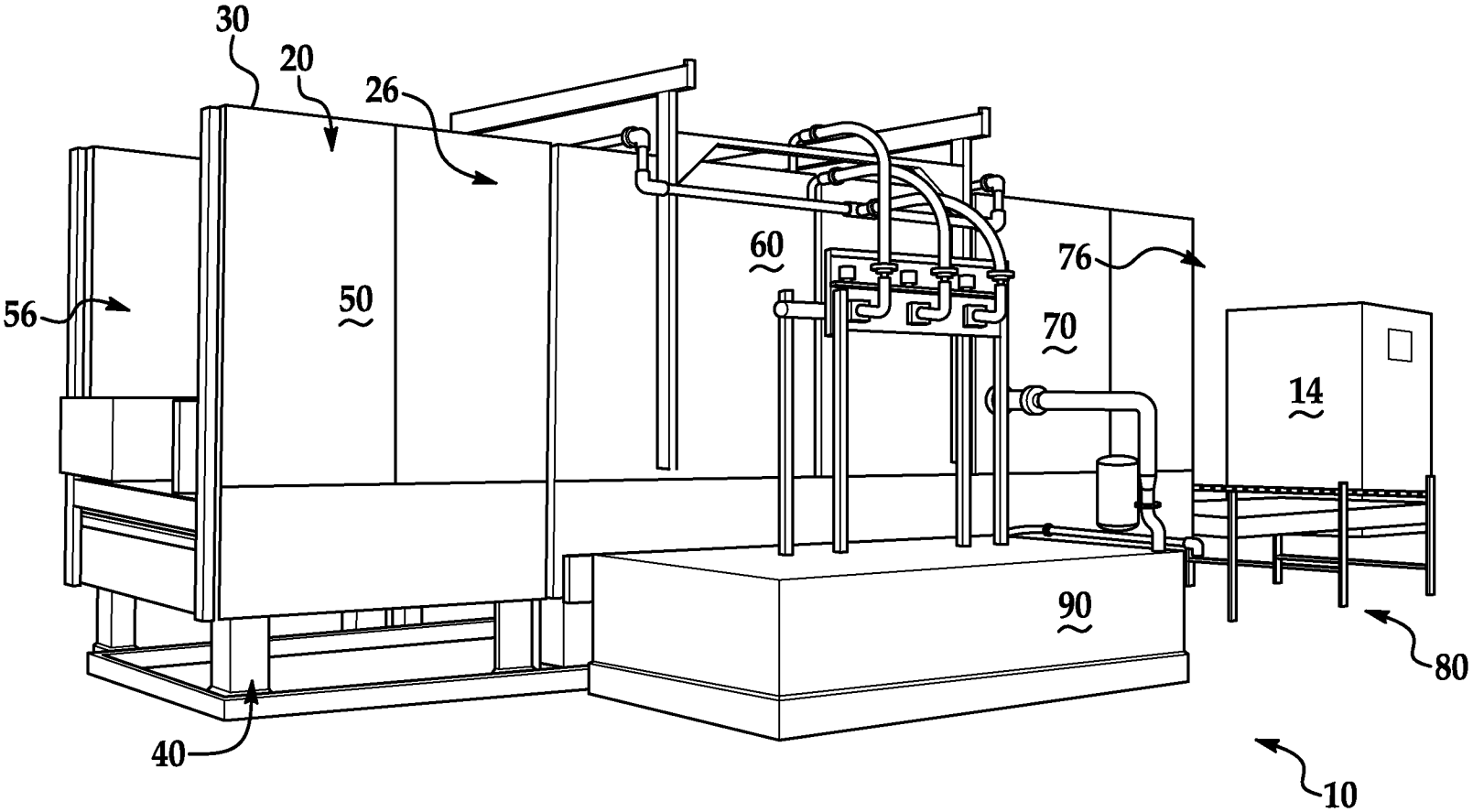
FIG. 1 is perspective view of an example of the inventive container washer.

Examples of a container washing device 10 and process 300 are illustrated in FIGS. 1-12 and described below. The preferred example illustrated is particularly useful in washing large agricultural seed storage and transport boxes, however, other uses known by those skilled in the art are within the scope of the invention.

Referring to FIGS. 1-4, an example of a container washing device 10 for washing an agricultural seed box 14 is illustrated. In the example washer 10 includes a self-contained, modular enclosure 20 having vertical side panels 26, a top 30 and an interior floor 36 supported by a base 40 as generally shown.

Figure 2:
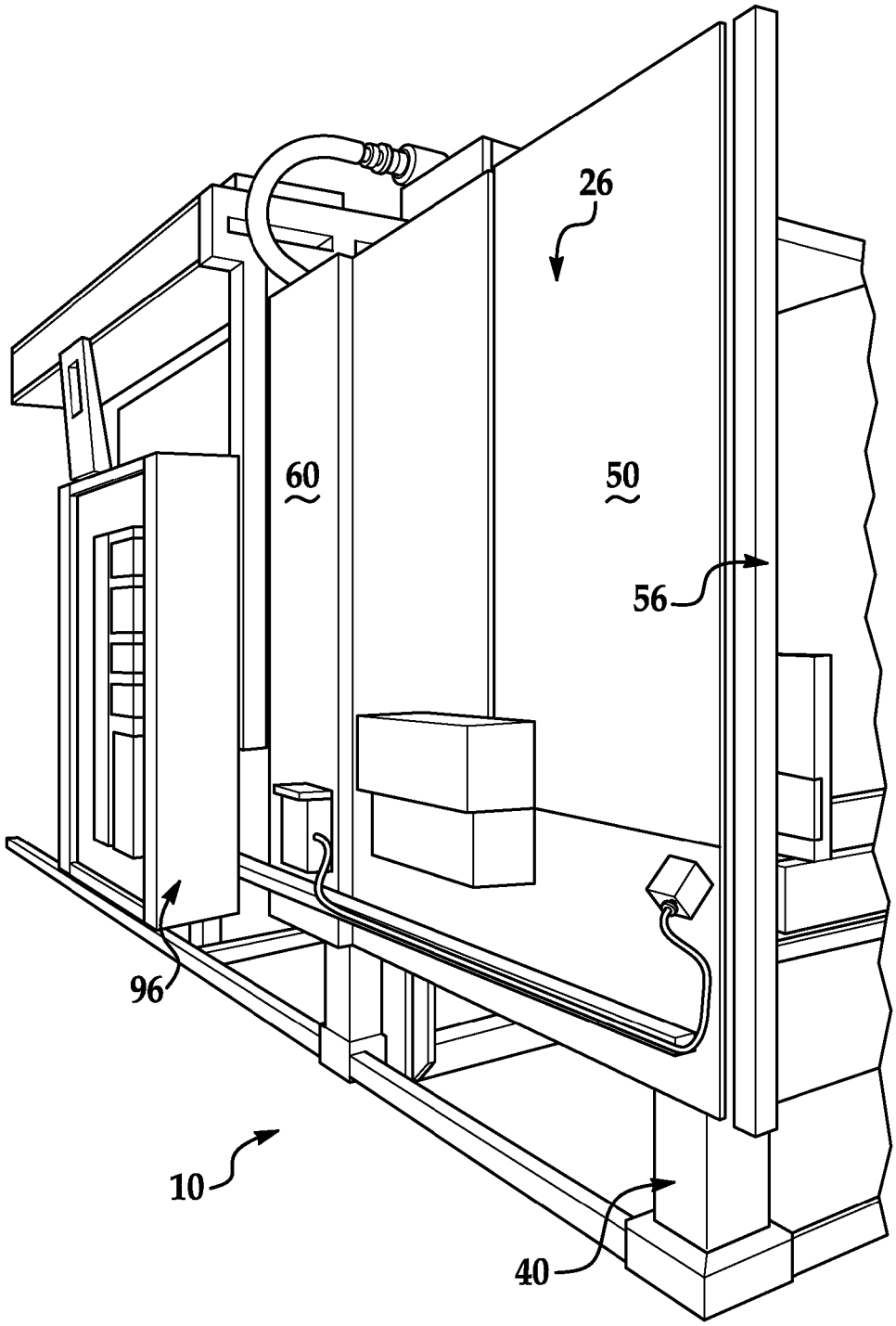
FIG. 2 is a rearward perspective view of the example washer shown in FIG. 1.
Figure 4:
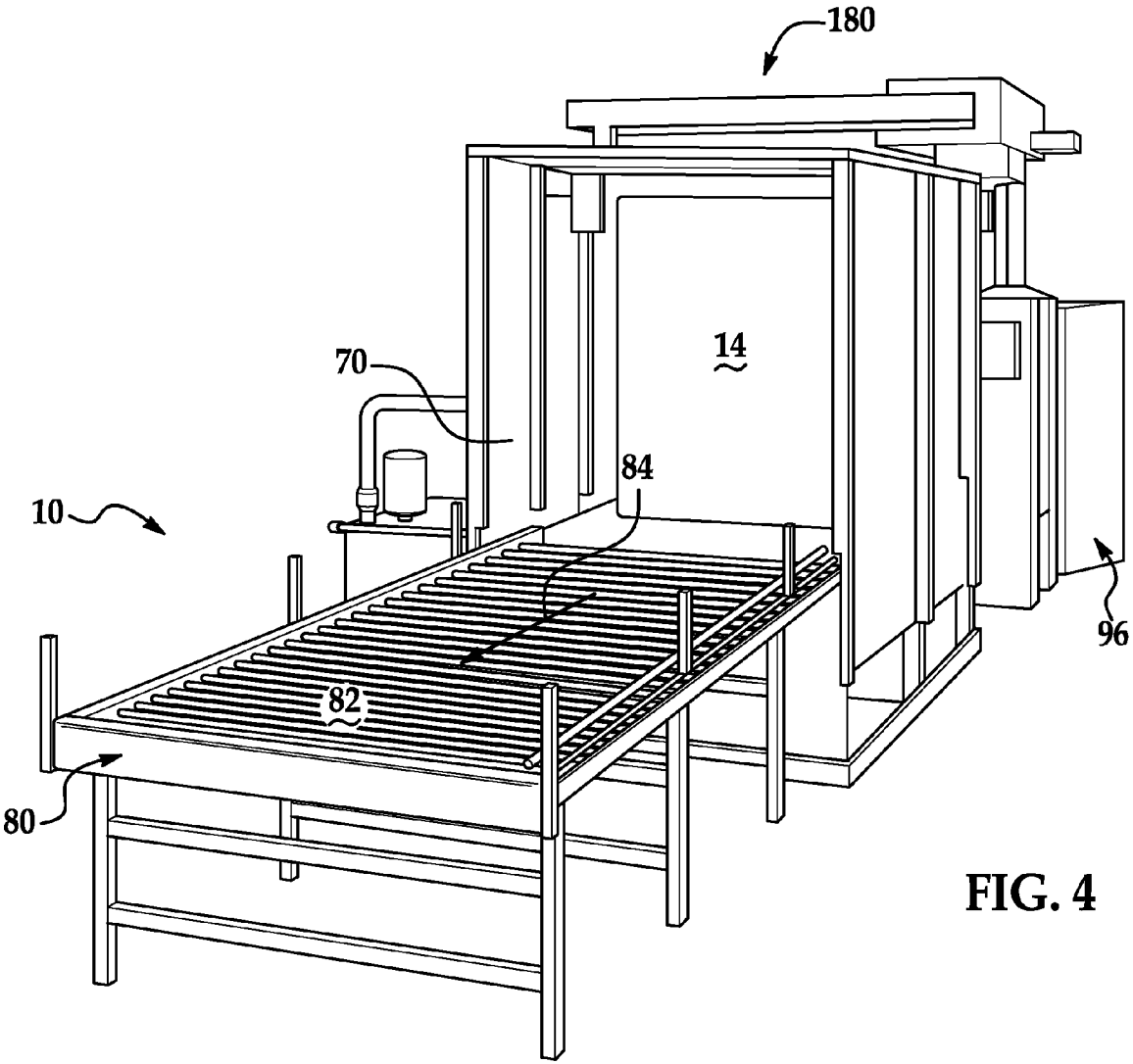
FIG. 4 is a perspective end view of the exit end of the example shown in FIG. 1.

As best seen in FIG. 1, enclosure 20 includes a first module 50 having a first or entrance end 56, a second module 60 defining an internal washing area 66 and a third module 70 having a second or washing exit end 76. As best seen in FIGS. 1 and 4, an exit transfer device 80 in the form of a conveyor including rollers 82 extends from third module 70. The modules from the first and sequentially through the second 60 and the third 70 defines a path of travel 84 for the exemplary seed box 14. As best seen in FIGS. 1 and 2, a washing fluid reservoir 90 is in fluid communication with the second module 60 and wash area as further described below. Washer 10 further includes a processor and controls 96 which are in electrical communication with the various components and drives as further described below. In a preferred example, enclosure 20 is made from stainless steel for use outdoors exposed to the environment. Other materials known by those skilled in the art may be used.

Figure 3:
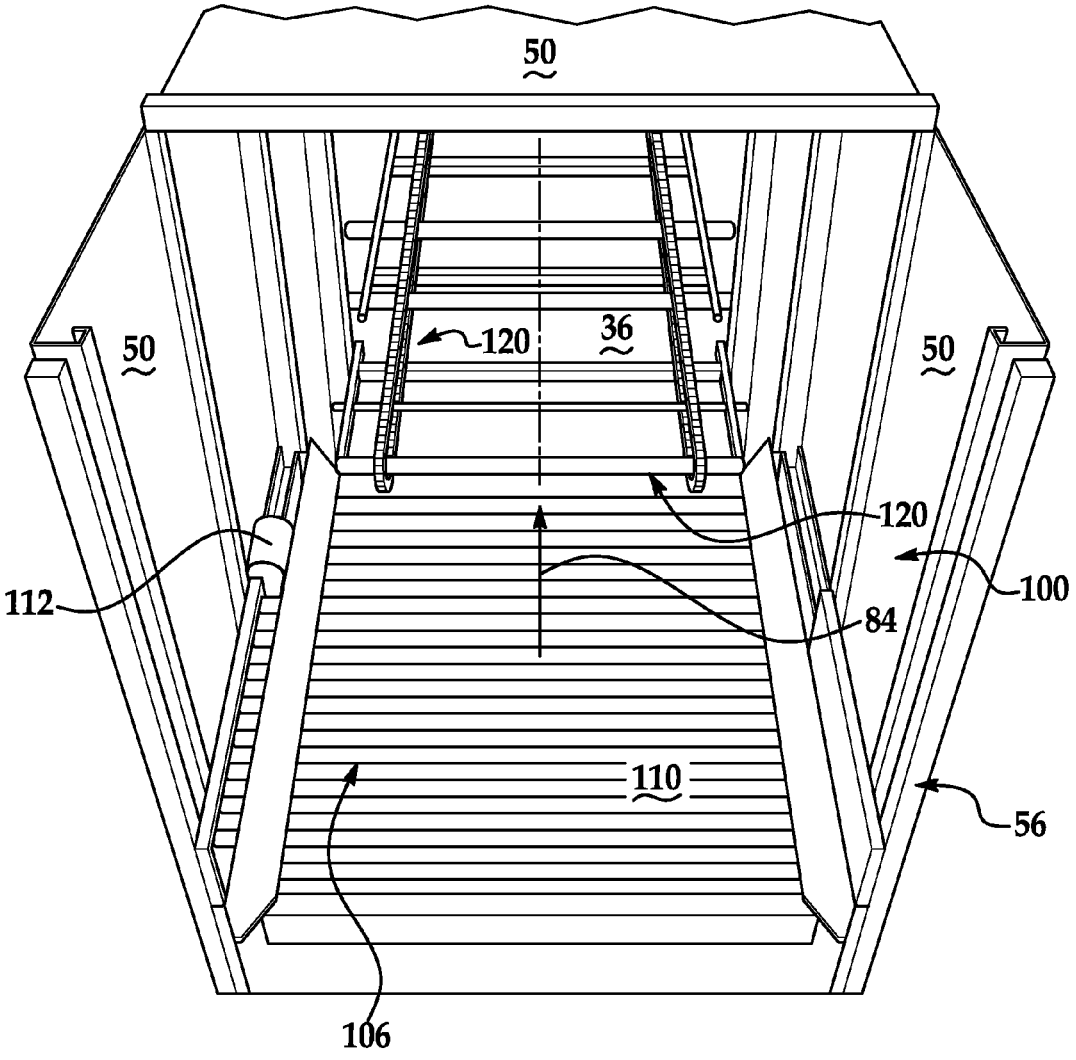
FIG. 3 is an end view of the entrance end of the example shown in FIG. 1.

Referring to FIG. 3, the exemplary first module 50 defines a seed box 14 entrance 100 including a transport device 106 in the form of a roller conveyor or transport 106 including rollers 110. In the example shown, several of the rollers are connected to an electric motor drive 112 connected to controller 96 to selectively rotate several of the rollers 110 to transport seed box 14 into engagement with the conveyor in the second module 60 washing area described below. In one example of device 10, entrance 100 and transport 106 are positioned elevated above a firm ground surface and seed boxes 14 are individually placed on transport 106 by a fork lift or other transport device. It is understood that other means to load seed boxes 14 onto transport 106 or into entrance 100, for example a powered conveyor (not shown), known by those skilled in the art may be used.

Figure 5A:
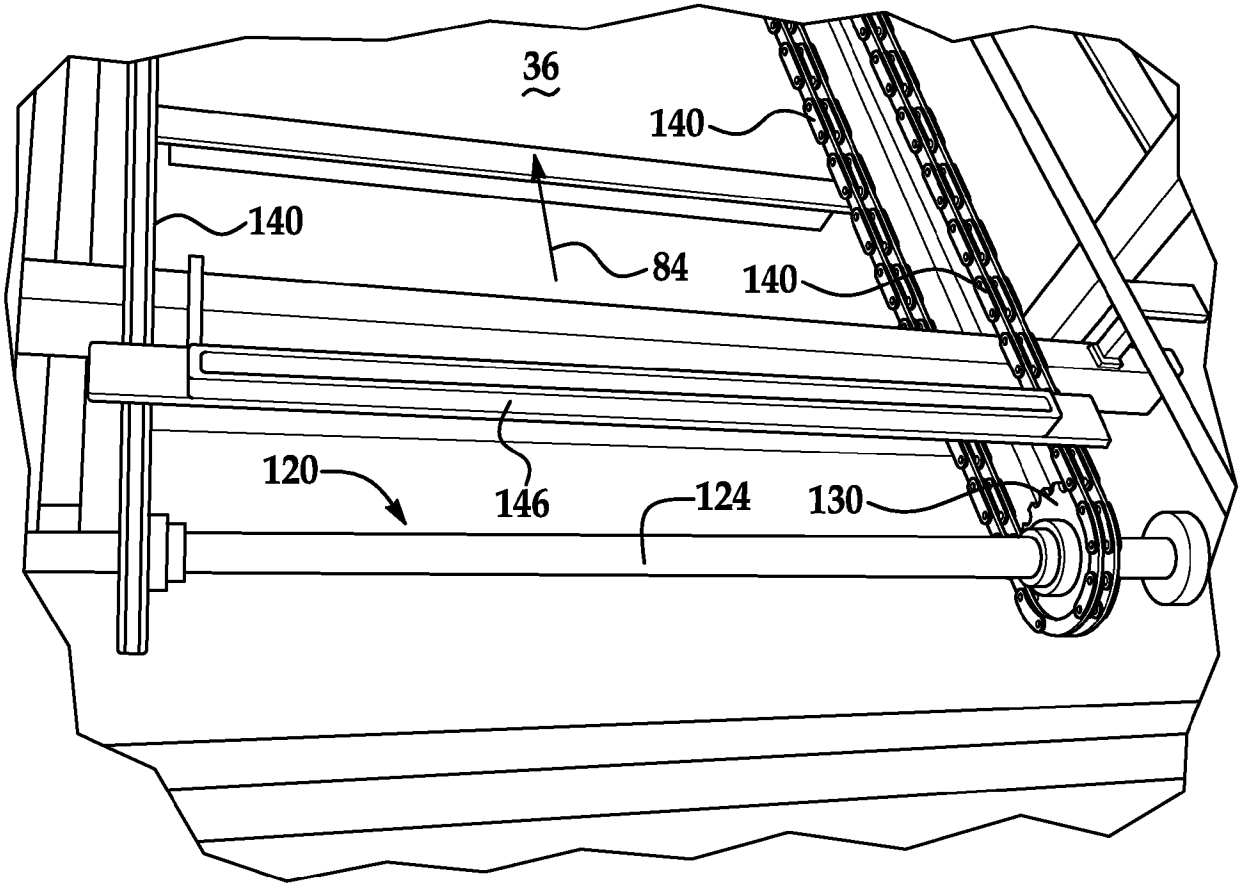
FIG. 5A is a plan view of a portion of the seed box conveyor in a wash area inside the example shown in FIG. 1.
Figure 5B:
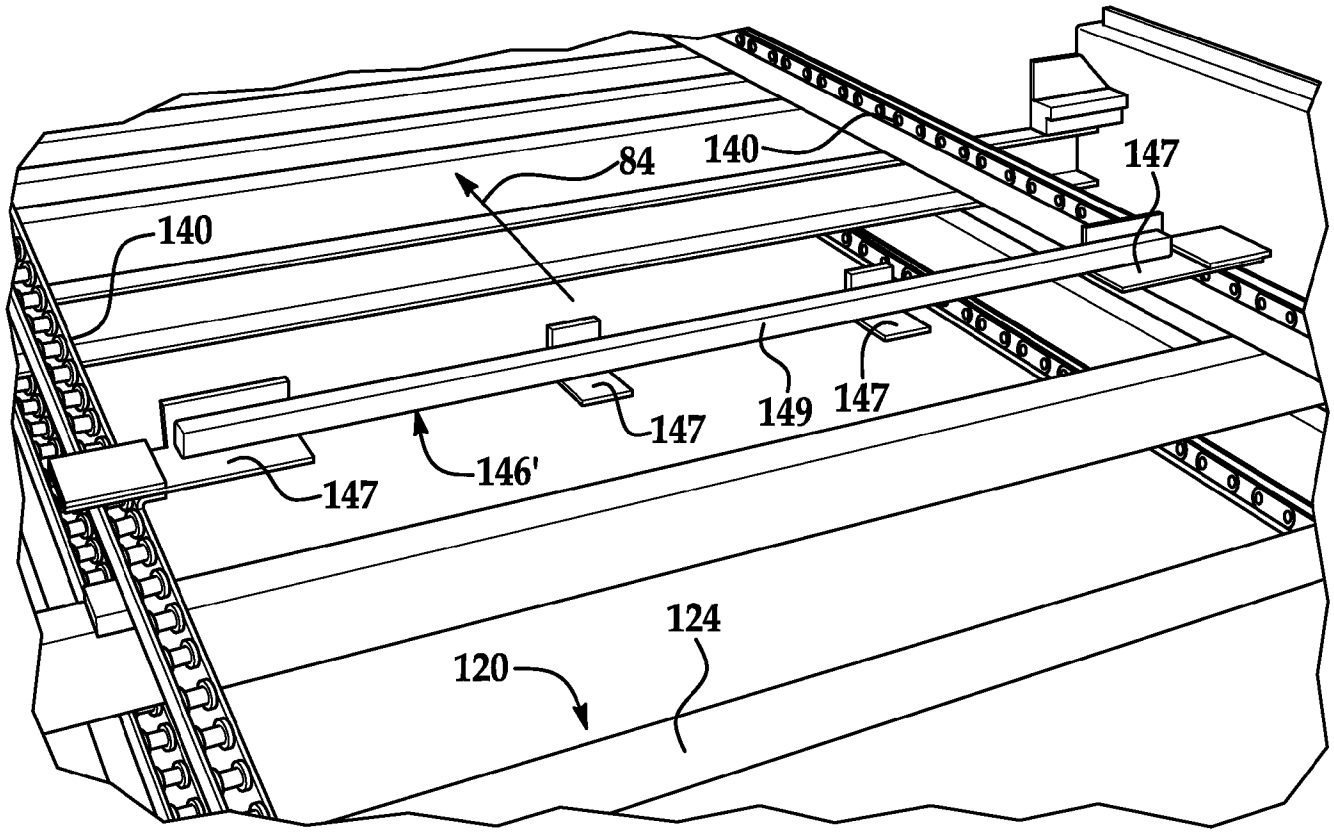
FIG. 5B is a plan view of another aspect of the portion of the seed box conveyor in a wash area inside the example shown in FIG. 1.
Figure 6:
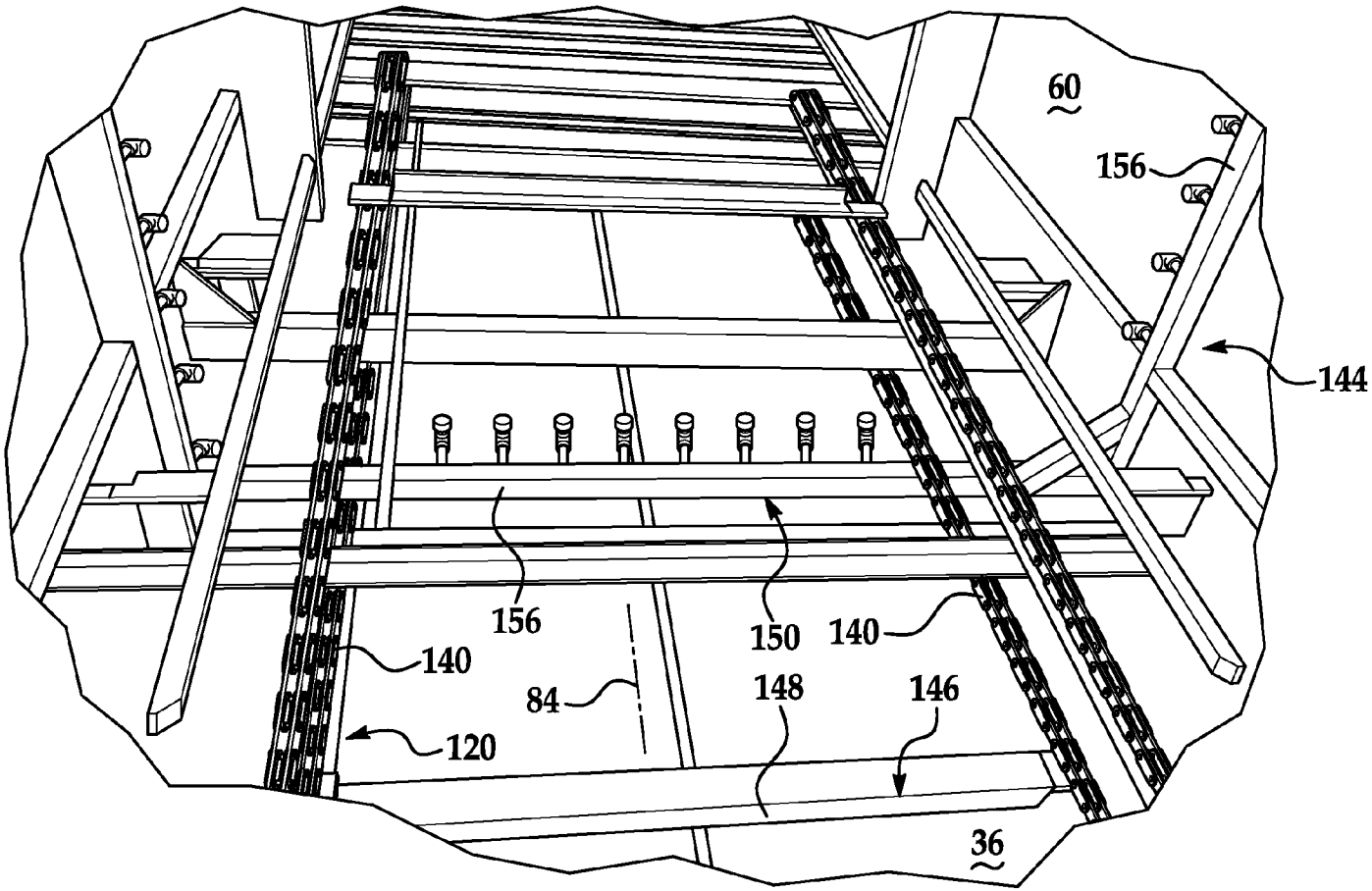
FIG. 6 is a plan view of a larger portion of the seed box conveyor and first spray array in FIG. 5A.
Figure 7:
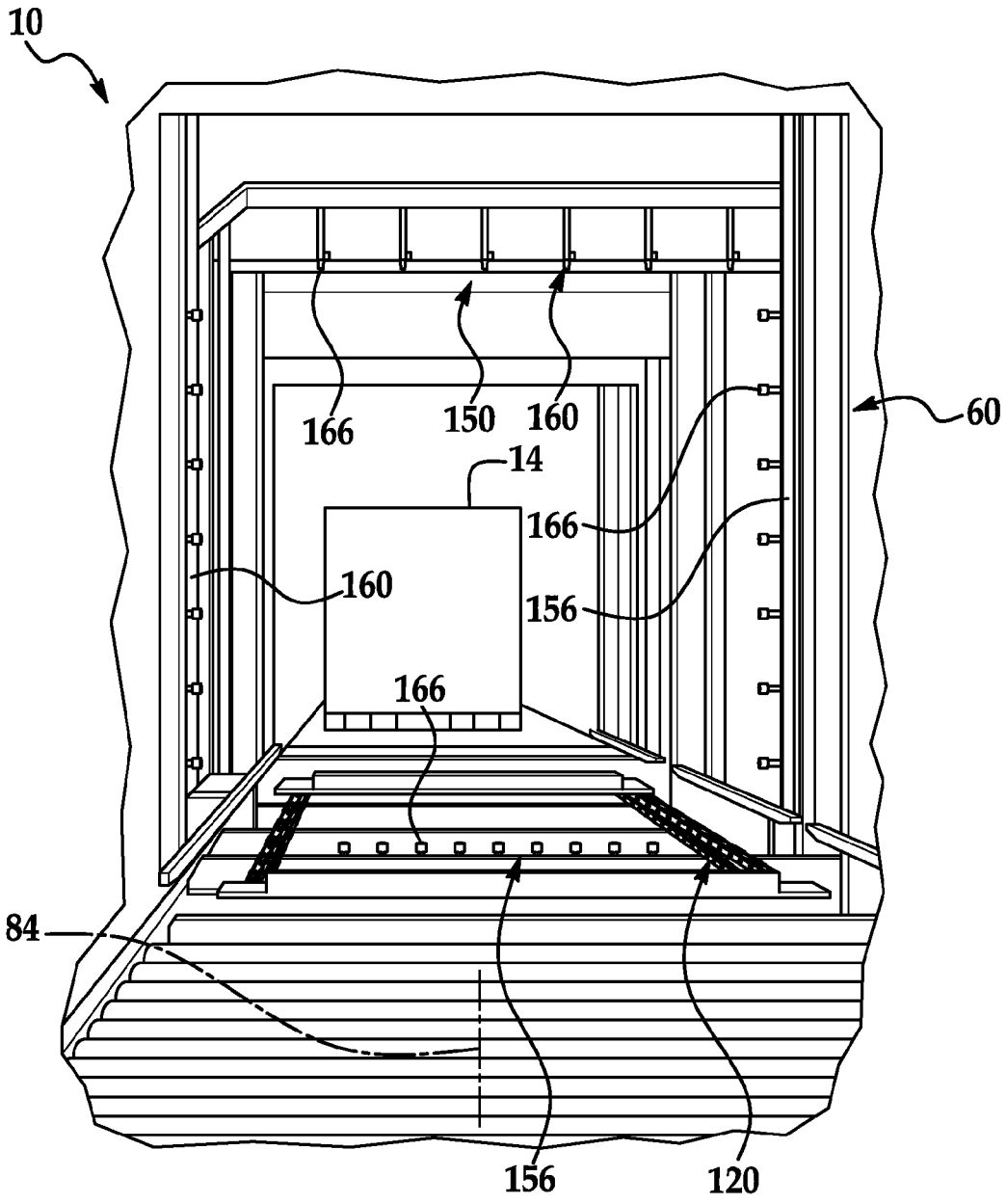
FIG. 7 is an end view from the perspective of the exit end of the example shown in FIG. 1.

Referring to FIGS. 5-7 an example of a conveyor 120 for selectively moving a seed box or other container back and forth through the wash spray arrays further described below is illustrated. In the example, a drive shaft 124 positioned transverse to the path of travel 84 is journaled to supports through bearings or other devices known to those skilled in the art. Shaft 124 is connected to an electric motor drive (not shown) which is in communication with controls 96 to selectively rotate the shaft about an axis of rotation. Shaft 124 includes a pair of sprockets 130 on opposing sides of the shaft which each engage a respective continuous loop chain 140 that extend parallel to the path of travel 84 through second module 60 to an opposing drive or slave shaft (not shown) on the opposing end of module 60 defining the spray wash or processing area 144. In the preferred example, steel chains 140 having a moisture resistant coating useful in the wash area are used. The steel chains are substantially not subject to linear expansion or stretching over time and are durable to support and convey the seed boxes 14 which are improvements over prior designs.

In the example shown, conveyor 120 includes a plurality of contact bars 146 spanning between and connected to the chains 140 as generally shown. Each contact bar 146 includes an extending flange 148 which when rotated to the upper path of the continuous chain path of travel, extends substantially vertically upward as best seen in FIG. 5A. The contact bars 148 are positioned separated from one another along the path of travel 84 a distance slightly longer than approximately the width of a seed box 14 (the dimension of the seed box when measured along the path of travel 48). When a seed box is positioned on the conveyor 120, an upward extending contact bar flange 148 is positioned on opposing sides of the seed box adjacent the lower edges of the box allowing the seed box 14 to be readily and selectively moved in either direction along the path of travel 48 as directed by drive motor 120 and chains 140.

FIG. 5B illustrates another embodiment of the contact bars 146'. Contact bar 146' has four minimal structural contact points 147 along the lower seed box 14 lower edge, although it is not limited to four. The reduced size contact points 147 are supported via a small tubing structure 149 which allows wash spray impingement water to better access an area of the seed box 14 lower edge.

Figure 9:
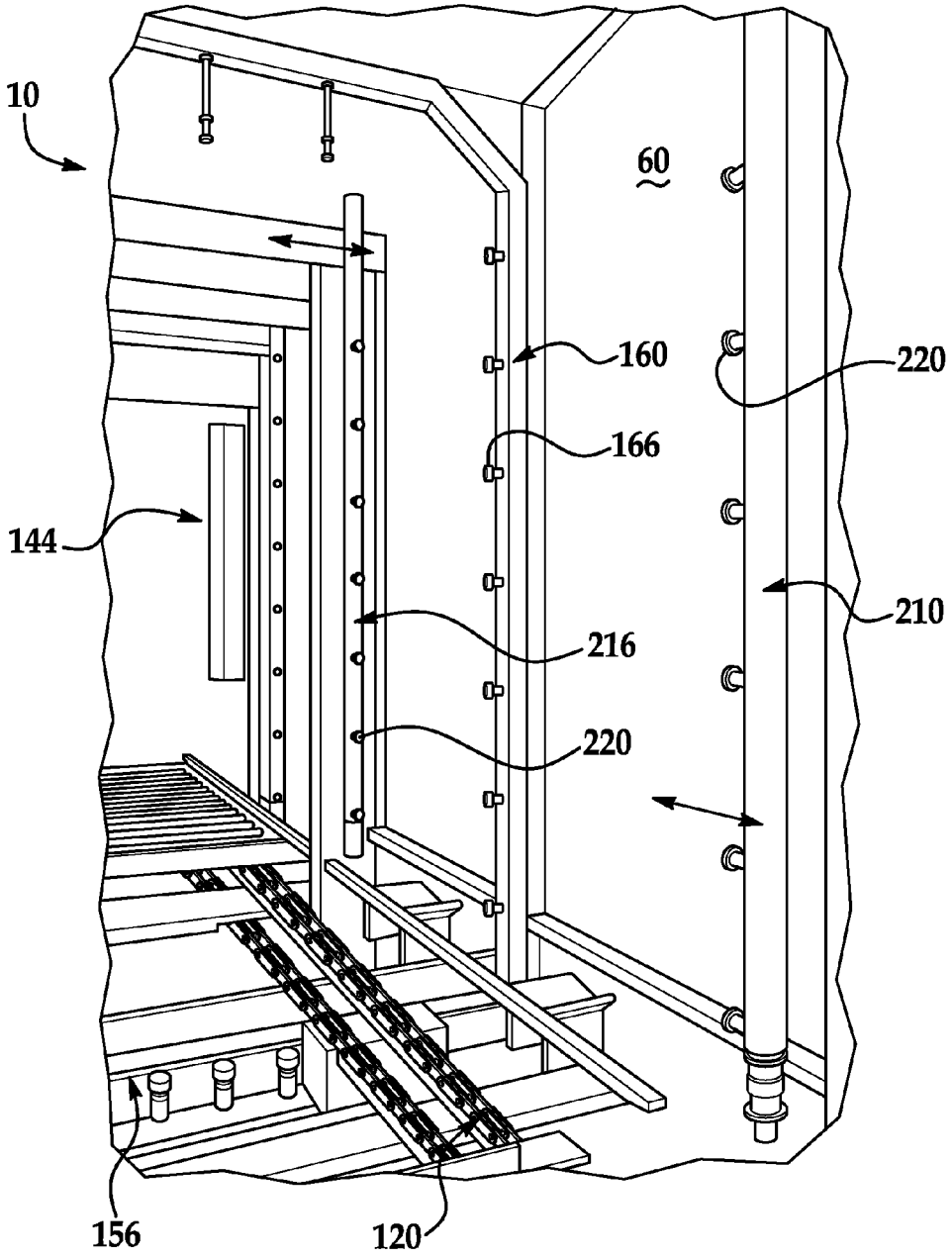
FIG. 9 is a perspective view of a portion of the first and second spray arrays inside the example shown in FIG. 1.

Referring to FIGS. 7 and 9, an example of the first spray array 150 is illustrated. In the example, a first spray manifold 156 and second spray manifold 160, each including a plurality of spray nozzles 166 are radially positioned around the spray wash area 144 substantially encompassing the path of travel 48, with 360° of fluid spray around the seed box 14. In a preferred example, first manifold 156 includes a through pipe or channel in fluid communication with the fluid reservoir 90 and appropriate valving (not shown) to selectively provide pressurized fluid spray through the manifold 156 to the spray nozzles connected to the manifold 156. In the preferred example, first manifold 156 spans the second module top 30 and one side 26. The second manifold 160 is similarly constructed and spans to floor 36 and the opposing side 26 thereby substantially surrounding a portion of the washing area 144 and encompassing the path of travel 48. In a preferred example further described below, spray fluid is selectively provided to only one of the first 156 and second 160 manifolds at a time so as to reduce the power requirements to generate high pressure spray and optimize fluid use and power consumption.

In one example of operation of the conveyor 120 and first spray array 150, on a seed box entering the spray wash area 144 through conveyor 120, one of the first 156 and 160 manifolds are activated providing pressurized fluid to the selected and valved manifold. The conveyor 120 is cycled to move the seed box along the path of travel 48 through the spray, so the entire box passes through the spray. Once the box is passed through, depending on the application and amount of debris to be removed, the spray through the first selected manifold may continue and the conveyor reversed to pass the seed box 14 back through the spray for another pass. Alternately, after the first pass, the first selected manifold may be deactivated and valving cycled by the controller 96 to provide pressurized fluid to the other manifold 156 or 160 in the first spray array 150 to conduct one, two or more passes of the seed box 14 through the spray as described. Although described as selectively activating only one of the manifolds 156 and 160 at a time, it is understood that both manifolds may be provided pressurized fluid simultaneously. On completion of the predetermined and preprogrammed washing cycle through the first spray array 150, the conveyor 120 is moved to a central or predetermined position in the wash area 144.

Figure 8:
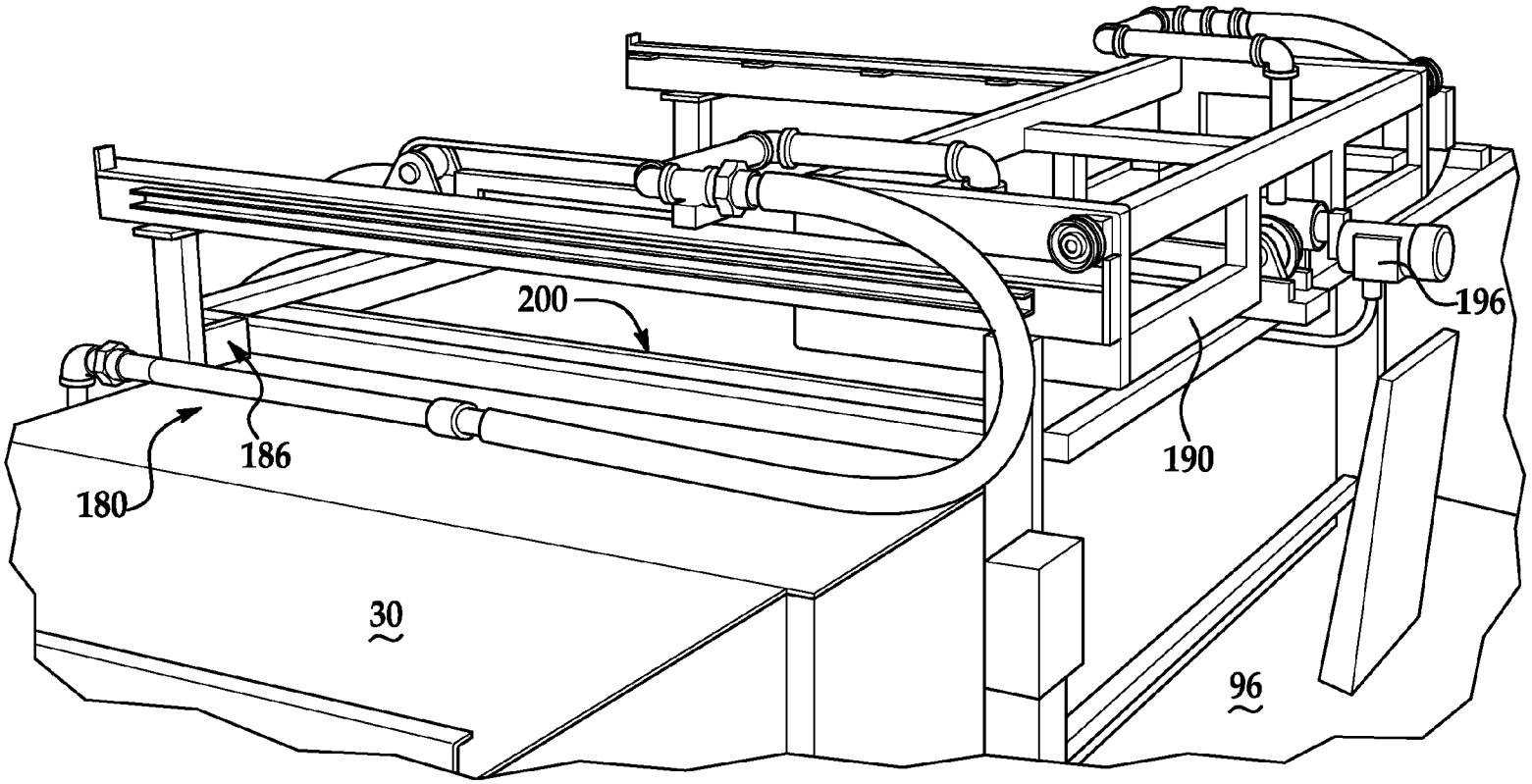
FIG. 8 is a perspective view of a portion of the second spray array positioned atop of the example shown in FIG. 1.

Referring to FIGS. 8 and 9, in one example of device 10, a second transverse spray array 180 is included. As best seen in FIG. 8, in the example, second spray array 180 includes a frame 186 positioned atop of the enclosure 20, a carriage 190 movably connected to the frame 186, a powered drive 196 engaged with the carriage 190 and a track 200 positioned transverse to the path of travel 48 for selectively guiding the carriage 196 back and forth along a predetermined path of travel. The drive 196 is in communication with the controller and is selectively powered in according to a predetermined and preprogrammed path.

Referring to FIG. 9, second spray array 180 further includes a first spray manifold 210 and a second spray array manifold 216 in fluid communication with the fluid reservoir 90 and each having a plurality of fluid spray nozzles 220 similar to that described for the first spray array 150. Each of the first 210 and second 216 manifolds are connected to the movable carriage 190 for selective transverse movement across the spray area 144. In the example, first 210 and second 216 manifolds are positioned apart and on opposing sides of the first spray array 150 manifolds along path of travel 48. In the preferred example, and similar to that described for the first spray array 150 manifolds, valving is employed to selectively provide pressurized fluid to only one of the first 210 and second 216 manifolds at a time. It is understood that both could be provided fluid simultaneously.

In an exemplary operation of second spray array 180, once the seed box is positioned centrally between the first 210 and second 216 manifolds, pressurized fluid is selectively provided to one of the first 210 or second 216. The powered drive 196 moves the carriage and connected manifolds along tracks 200 to spray the seed box 14 in a transverse direction to that as sprayed by the first spray array 150 in a first pass. The drive 196 is then reversed and the manifolds are moved back to their starting position in a second pass as similarly described for the first spray array. One or more additional passes with the first selected manifold being provided fluid may be made to suit the particular application and performance requirements. On completion of the predetermined passes for spraying by the first selected manifold, valving is actuated by controller 96 to provide spray fluid to the other manifold 210 or 216 and one or more passes of spray of the seed box 14 are made as similarly described above. On completion of spraying by second spray array 180, the first 210 and second 216 manifolds are moved to a position clear of the path of travel as shown in FIG. 9.

On completion of the predetermined and preprogrammed spray cycle in wash area 144, conveyor 120 is activated and moves the washed seed box 14 to the third module 70 for deposit of the seed box 14 onto the exit transport 80 and rollers 82. In one example, exit transport rollers 82 may be powered by a drive (not shown) to transport the seed box 14 away from third module 70 for further removal, for example by a forklift or other transport mechanism, and processing.

In an alternate example (not shown), exit transport rollers 82 may be "one-way" rollers which are capable of only rolling in the direction to move the seed box 14 along the path of travel 84. This prevents seed boxes 14 that have already passed through the wash area 144 from easily moving backward against the path of travel onto the third module 70 or wash area 144. Field testing has shown that in areas of operation in high wind, wind forces can push washed seed boxes against the path of travel 84 back into the third module 70 and disrupt the flow of subsequent boxes. Other devices for deterring or preventing the movement of seed boxes against the path of travel 84 known by those skilled in the art may be used.

Figure 10:
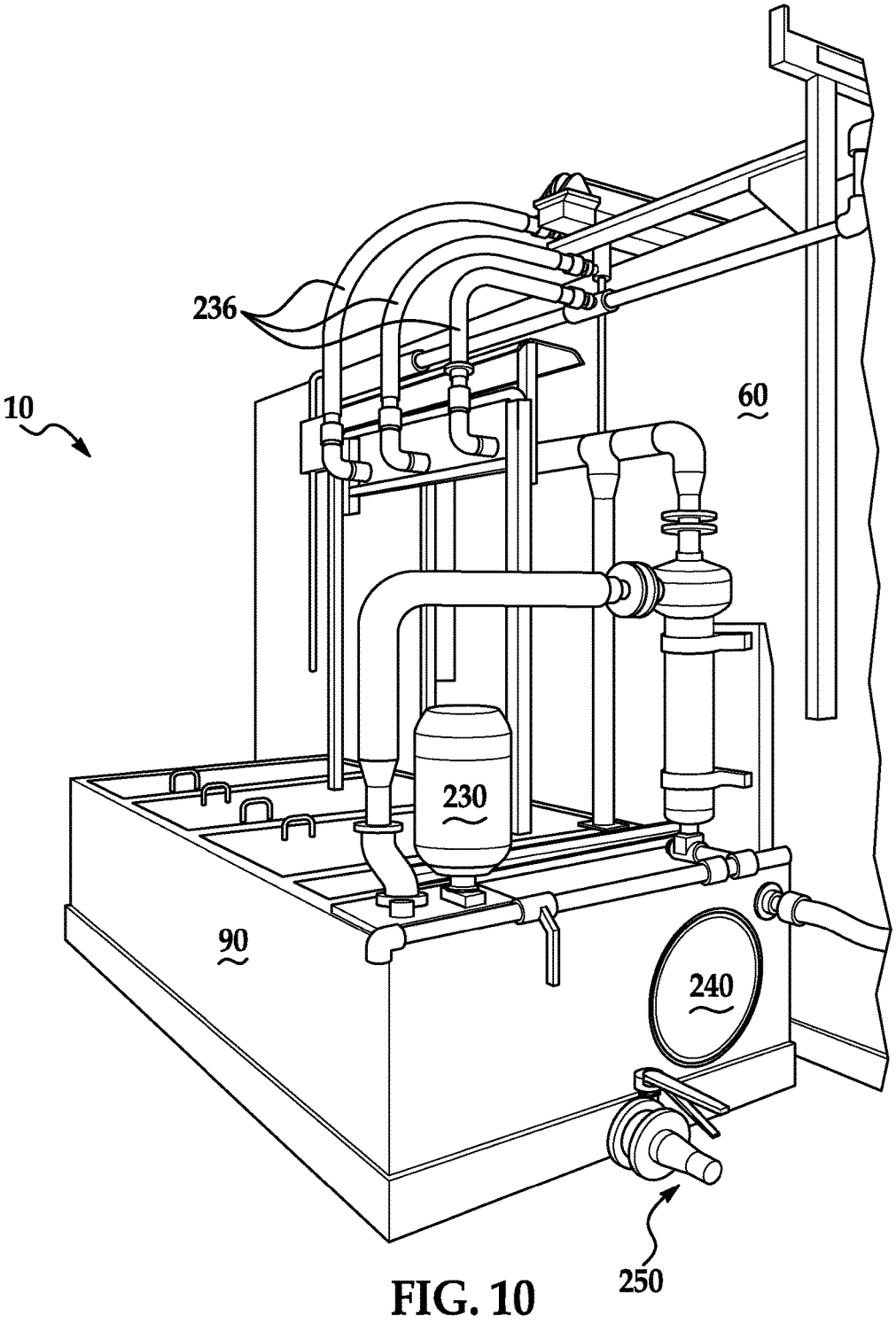
FIG. 10 is a perspective view of a front side of the example shown in FIG. 1.

Referring to FIG. 10, and example of device 10 fluid reservoir 90 and wash pump 230 is illustrated. In a preferred example, device 10 enclosure floor 36 include a drainage system (not shown) and configuration whereby drain fluid is directed by the enclosure 20 and floor 36 through one or more drains which are in fluid communication with the reservoir 90. This may be through floor 36 being angularly oriented in one or more areas to direct sprayed fluid to a respective drain. In a preferred example, substantially all of the sprayed fluid is contained in enclosure 20 and captured by the drain system for filtration and recirculation as described below.

In one example, fluid drained from the enclosure 20 is directed to a filtration system whereby dirt and other debris is screened or filtered from the fluid, typically water, before being allowed to travel to the main reservoir 90. This may be accomplished by one or more filtration stages and valves in fluid communication with the enclosure drains and reservoir. In one example, one or more debris screens may be used to filter out large particulate. Other mechanism, alternately or in combination may be used for example, a centrifuge device (not shown) to separate the contaminants from the fluid before the fluid returns from to the reservoir may be employed. These various filtration devices would be removable for cleaning and reinsertion for substantially continuous operation. For example, an access door 240 in reservoir 90 may be used to clean any debris that passes to the reservoir or for maintenance purposes. An exit drain 250 is illustrated to empty or flush the reservoir and spraying system for routine maintenance or to change to an alternate spraying fluid. Other filtrations devices and systems known by those skilled in the art may be used. A fresh water or fluid inlet line and valve (not shown) is used to initially supply the reservoir with spray fluid and to maintain a predetermined level which may be monitored by controller 96.

In an alternate example (not shown), in place of a filtration system, a purge system may be employed to efficiently remove the used fluid from the device 10 where such fluid cannot be recycled or it is too inefficient to do so. In such alternate example, a fresh fluid intake line and appropriate valves may be used to supply on demand fluid for the wash process or provide on demand supply to reservoir 90 to support the process.

In the example shown in FIG. 10, an exemplary wash pump 230 is shown. Pump 230 is in fluid communication with the reservoir and first 150 and second 180 spray arrays and respective manifolds through pipes 230 and controlled valves (not shown). As described, in a preferred example, through use of selective supply of pressurized fluid to only one spray manifold at a time, and through coordinated and cyclical movement of the conveyor 120 and carriage 190, it has been determined that effective and sufficient washing of seed boxes 14 can be accomplished through a much less powerful pump 230 than previous designs. For example, it has been found that a 15 horsepower pump 230 may be used where prior designs required pumps having 40 or more horsepower. This is a significant improvement over prior designs in power consumption and per unit cost. Other improvements in the overall device 10 are achieved as well. Through the combination of these components and processes, the rate that units, for example seed boxes 14, can be washed and processed remains competitive with or even improved over prior designs while achieving all of the efficiencies and improvements described above.

In an alternate example (not shown), following the end of unit 10, a further conveyor device, for example a roller conveyor similar to transport 106, can be used to extend the path of travel 84 to other equipment, for example a dryer unit (not shown). In one example, a dryer unit in the form of a spinner device may be used to remove excess water from the sprayed and cleaned seed box 14. In the example, a support and vertical frame device is used to define a drying area within the frame, and a rotatable base which supports and selectively rotates the seed box 14. In operation, a clean seed box exits second end 76 and continues along a conveyor and into the dryer unit which is preferably positioned at the same height as the container washer 10.

In one example, the dryer support grasps or engages the seed box base or bottom. The support therein is rapidly spun to remove excess water on and in the seed box 14. On completion of the drying cycle, additional equipment, for example an unload recovery gravity conveyor may be used to further transport and/or manipulate the seed box for further processing or logistics by the user as known by those skilled in the art. It is understood that other dryer devices, and other equipment, may be used along with the modular unit 10 and be included in the process of operation.

Figure 11:
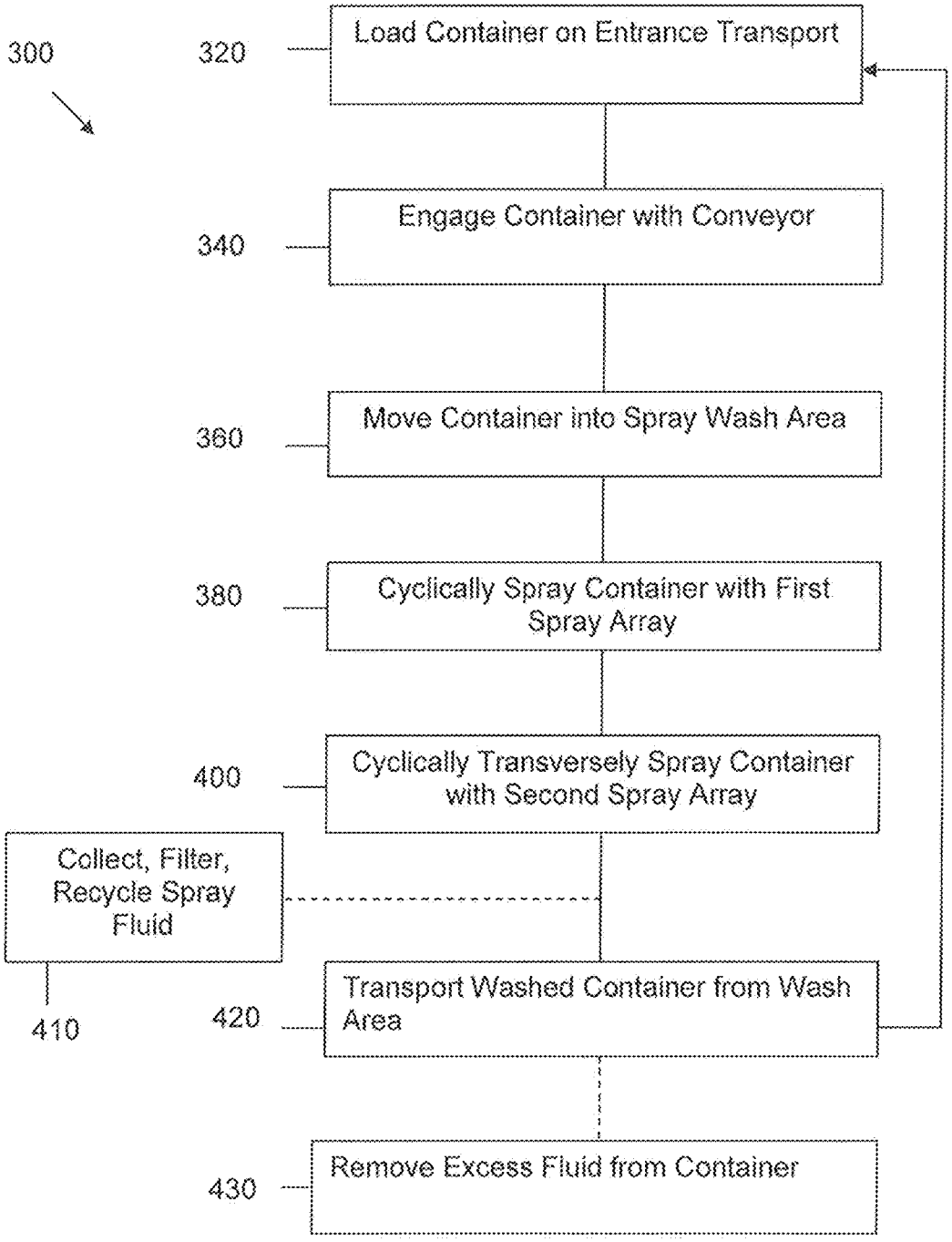
FIG. 11 is schematic flow chart of an example of a process to wash containers using the exemplary device shown in FIG. 1.

Referring to FIG. 11, an exemplary process 300 for washing a container, for example a seed box 14, using the above described device 10 is illustrated. As generally described and illustrated above, an exemplary device 10 or similar device is provided.

In step 320, a container, for example a seed box 14 is provided for processing, for example washing debris away with water or a cleaning solution. The seed box 14 is loaded onto an entry transport 106 as part of a first module 50 by a forklift or other conveyor device. It is understood that the seed box 14 could be loaded directly into the second module 60 or washing area 144 directly.

In step 340, the seed box 14 is engaged by a conveyer, for example 120 with contact bars 146 which engage both sides or bottom edges of the box along the path of travel 48. The conveyor 120 in step 360 moves the box into a wash area 144 into the path of the first spray array 150.

In step 380, selected spray from the first spray array 150 is initiated and the box is moved along the path of travel 48 to make at least one pass through the spray. As described above, conveyor 120 can be reversed in direction to make multiple passes. In alternate steps not show, the first 156 and second 160 spray manifolds may be separately and sequentially initiated to conserve water and power consumption by the pump. One or more passes of the box through the subsequent manifold spray may take place as described above.

In step 400, the conveyor is stopped positioning the box between the respective first 210 and second 216 manifolds of the second spray array 180. The manifolds are selectively activated to spray and moved along tracks in a direction transverse to the box path of travel 48 to spray the box as described above.

Once the predetermined and preprogrammed wash cycle is complete, in step 420 the conveyor 120 moves to box 14 from the wash area 144 to exit the wash device 10 for removal and/or further processing. A new box 14 begins the loading process for rapid and high volume throughput of boxes 14.

In an alternate step 410, during or after a wash cycle, the spray fluid is gathered/directed, collected, filtered and/or recycled and transported to a reservoir 90 for use in the next or subsequent wash cycles.

In an alternate step 430, the seed box is positioned in a dryer located along the path of travel 84 wherein excess water or fluid is removed from the seed box 14 by a procedure, for example spinning the seed box about a rotational axis and using centrifugal force to remove the water. Other processes can be used, for example compressed air through manifolds and other processes known by those skilled in the art.

In additional and/or alternate steps not shown, the device 10 controller 96 is preprogrammed to establish the desired sequence of events including, but not limited to, movement of the box, initiation of the spray cycle and the number of spray passes by the first 150 and second 180 spray arrays and exit of the box from the device 10. Controller 96 further includes many activation and monitoring functions, for example, the activation of fluid control valves to provide fluid to the spray manifolds, the various powered drives for the conveyors and second spray array 180 and the wash pump 230. Other controls, operations and processes known by those skilled in the art may be used.

The present inventive device 10 and process 300, although described as useful in washing an agricultural seed box 14, has many other uses for washing different containers and other objects as well as other functions besides washing with water or cleaning solution. The spray or dispersion of other fluids and media, through different nozzles and transfer devices appropriate for those alternate applications known by those skilled in the art may be used.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A spray washing device for use in washing agricultural containers, the device comprising:

an enclosure defining a single unpartitioned washing area and a path of travel through the washing area;

a first spray array positioned inside the single unpartitioned washing area at least partially encompassing the path of travel;

a second spray array positioned inside the washing area, the second spray array including a first manifold positioned in the single wash area on an upstream side of the first spray array along the path of travel and a second manifold positioned in the single wash area on a downstream side of the first spray array along the path of travel, the second spray array selectively movable in a direction transverse to the path of travel to provide spray to all six geometric surfaces of the container in the same single unpartitioned wash area; and a conveyor extending through the single unpartitioned washing area, the conveyor operable to support the container and selectively move the container back and forth through the first and second spray arrays along the path of travel to wash the container.

2. The device of claim 1, wherein the enclosure comprises:

a first module positioned along the path of travel defining the device entrance opening;

a second module positioned along the path of travel defining the single unpartitioned washing area; and a third module positioned along the path of travel defining an exit from the single unpartitioned washing area.

3. The spray device of claim 2 wherein the first and second manifolds are connected to a carriage mounted to a track positioned and mounted atop of an exterior of the second module for guiding the carriage on the track, the carriage connected to a drive source to selectively move the carriage and connected first and second manifolds back and forth transverse to the container path of travel.

4. The spray device of claim 3, wherein the first and second manifolds extend downward from the carriage through a top of the second module and into the second module single unpartitioned washing area.

5. The device of claim 1 wherein the conveyor has a forward transport mode for moving the container along the path of travel and a reverse transport mode for moving the container in a direction against the path of travel.

6. The device of claim 5 wherein the conveyor further comprises:

a pair of continuous chains separated on opposing sides of the path of travel, the chain engaging a drive shaft and a slave shaft operable to move the chains along the path of travel;

a plurality of contact bars positioned transverse to the path of travel and connected on opposing ends to the respective pair of chains, the contact bars are separated from one another along the path of travel at a distance greater than a width of the container and include at least one upstanding flange to abuttingly engage a portion of the container to forcibly move the container along the path of travel through the washing area whether the conveyor is in the forward mode or reverse mode.

7. The spray device of claim 1 further comprising:

a fluid reservoir in fluid communication with the first and the second spray arrays for transfer of fluid from the fluid reservoir to the respective first and second spray arrays; and a fluid pump in fluid communication with the fluid reservoir and the first and the second spray arrays for providing pressurized fluid to the spray arrays.

8. The spray device of claim 7 wherein the enclosure comprises a floor having a downwardly angled drain path in fluid communication with the fluid reservoir for directing sprayed fluid from the washing area to the fluid reservoir for reuse.

9. The spray device of claim 7 wherein the fluid reservoir further comprises a removable filter for collection of debris from the fluid before the fluid is reused in the washing area.

10. The spray device of claim 7 further comprising a plurality of valves positioned in fluid communication between the fluid reservoir and the respective first and second spray arrays, the valves are selectively opened or closed to selectively provide fluid to one of the first and the second spray arrays.

11. The device of claim 10 wherein the plurality of valves are selectively opened or closed to provide fluid to only a portion of the respective first and second spray arrays.

12. The spray device of claim 11 further comprising a controller, wherein the first spray array includes a first manifold and a second manifold, and the controller controls the plurality of valves to selectively provide fluid to only one of the first manifold and the second manifold at a time.

13. The spray device of claim 12, wherein the first manifold spans a top and a first side of the path of travel, and the second manifold spans a bottom and a second side of the path of travel.

14. The spray device of claim 12, wherein the controller selectively controls the plurality of valves to selectively provide fluid to both the first manifold and the second manifold at another time.

15. The device of claim 1 further comprising a dryer device positioned along the path of travel downstream of the washing area.

16. A modular agricultural seed box spray washing device comprising:

a modular enclosure having a first module defining an entrance, a second module defining a single unpartitioned washing area and a third module defining an exit, the first, second and third modules sequentially positioned and defining a path of travel;

a stationary first spray array positioned inside the single unpartitioned washing area substantially encircling the path of travel, the first spray array having a first manifold extending partially around the path of travel and a second manifold positioned partially around the path of travel, the first spray array positioned to spray a fluid in a direction substantially perpendicular to the path of travel toward the seed box;

a second spray array positioned inside the single unpartitioned washing area, the second spray array having a first manifold and a second manifold positioned on opposing sides of the first spray array along the path of travel, the second spray array first and the second manifolds selectively movable in a direction transverse to the path of travel and positioned to spray the fluid in a direction substantially parallel to the path of travel toward the seed box to spray all six geometric sides of the seed box in the single unpartitioned washing area;

a conveyor positioned in the enclosure and extending through the single unpartitioned washing area, the conveyor having a pair of opposing continuous chains having a plurality of contact bars separated from one another by at least a width of the seed box, the conveyor having a forward transport mode for moving the seed box along the path of travel and a reverse transport mode for moving the seed box in a direction against the path of travel, the conveyor operable to support and selectively move the seed box back and forth through the first and the second spray arrays along the path of travel to wash the seed box;

a fluid reservoir in fluid communication with the first and the second spray arrays;

a fluid pump for providing pressurized fluid from the reservoir to the first and the second spray arrays; and a plurality of valves positioned in fluid communication between the pump and the respective first and second manifolds of the respective first and second spray arrays, the respective valves are selectively positioned in an open or a closed position to selectively provide fluid to one of the first or the second manifolds of one of the first or the second spray arrays.

17. A spray washing device for use in washing agricultural containers, the device comprising:

means for loading a container onto a conveyor to be supported thereon;

means for moving the conveyor and supported container along a path of travel into a single unpartitioned washing area:

means for spraying the container in the single unpartitioned washing area with a fluid through a stationary first spray array positioned in the single unpartitioned washing area substantially encircling the path of travel while selectively moving the conveyor through the first spray array for at least a first pass;

means for spraying the container with a second spray array positioned in the single unpartitioned washing area having a first manifold and a second manifold positioned on opposing sides of the first spray array while moving the second spray array transverse to the path of travel relative to the container; and means for moving the conveyor and supported container from the single unpartitioned washing area.

* * * * *